United States Patent [19]

Manzi

[11] 4,451,035

[45] May 29, 1984

[54] PULL AND RELEASE EXERCISE DEVICE

[75] Inventor: Joseph Manzi, New York, N.Y.

[73] Assignee: Gossling Development Corporation, New York, N.Y.

[21] Appl. No.: 409,623

[22] Filed: Aug. 19, 1982

[51] Int. Cl.[3] ..... A63B 21/02; A63B 21/32

[52] U.S. Cl. ..... 272/137

[58] Field of Search ..... 272/135-143, 272/67-68, 125-126

[56] References Cited

U.S. PATENT DOCUMENTS 4,262,898 4/1981 Lee ..... 272/68

FOREIGN PATENT DOCUMENTS 14147 11/1903 Fed. Rep. of Germany ..... 272/68

999526 11/1949 France ..... 272/140

*Primary Examiner*—Richard J. Apley

*Assistant Examiner*—Chris Coppens

[57] ABSTRACT

A two handed exerciser of flexable metal rod having major and secondary coils at each end of elongated members, with reinforcing members to provide additional resistance, and with handgrips. A wide range of exercises are effected by pulling apart and bringing together the handgrips thereby inducing expansion in the secondary coils and compression in the major coils; the combined effect gives capacity to the device.

1 Claim, 4 Drawing Figures

FIG. 1
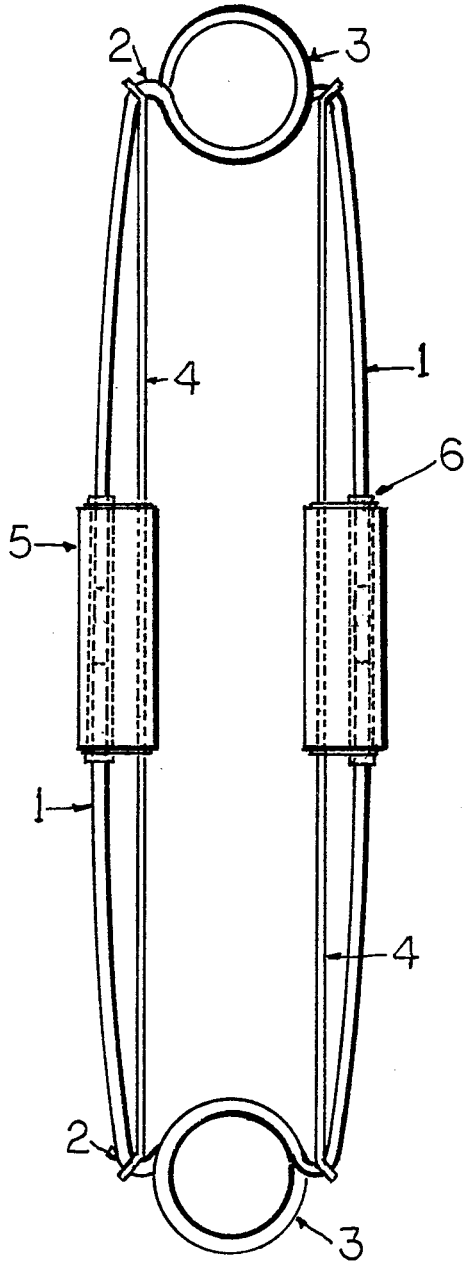
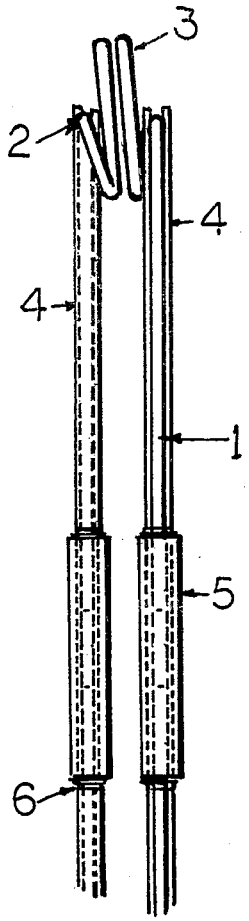
FIG. 2

PULL AND RELEASE EXERCISE DEVICE

BACKGROUND OF THE INVENTION

The present invention relates to a new device for use by men and women to assist in a wide range of isometric exercises for toning and strengthening the entire body muscleature and to improve health by aiding weight control and breathing capacity while not creating burdens in cost, time and fatigue for the user.

Diverse exercise devices are available; some utilize multiples of spring coils, others have pulleys, or expandable rope or cables. Though these devices constitute novel combinations of the component parts, they do not give to the user a full benefit for the effort and time required to properly use such devices.

Consequently, the need exists for a cost effective and time effective exercise device which will conserve rather than needlessly expend a user's energy.

OBJECT OF THE INVENTION

The object of the invention is to provide a novel device by which the user can experience maximum exercise benefit for the effort expended by directing energy to elements of the invention which offer constant resistance in the pull and the release phases of the exercise cycle.

SUMMARY OF THE INVENTION

According to the present invention there is provided a physical exercise device comprising two major coils and four secondary coils at opposing ends of elongated members, handgrips which house the joined ends of said members and reinforcing members which attach to the grips and extend to the secondary coils. Exercise is achieved by pulling apart the hand grips which causes expansion and compression in the coils; relaxation of the pull cycle allows musclature recovery prior to another cycle.

Preferably, the major and secondary coils are formed as part of the elongated members which are of spring grade metal rod and provide the force means as handgrips are pulled apart and brought together.

Advantageously, the secondary coils are formed in reverse direction to that of the major coils so as to induce compression in the major coils when the secondary coils are expanded. Further compression is provided by the reinforcing parts.

In the preferred embodiment, the reinforcing members impart compression to the major coils in conjunction with the elongated members by providing additional expansion potential to the secondary coils.

BRIEF DESCRIPTION OF THE DRAWINGS

The invention is further described by reference to the accompanying drawings, in which:

FIG. 1 is a side elevation of the exercise device according to the invention FIG. 2 is a front elevation of the exercise device

DETAILED DESCRIPTION OF THE PREFERRED EMBODIMENT

Figure 4:
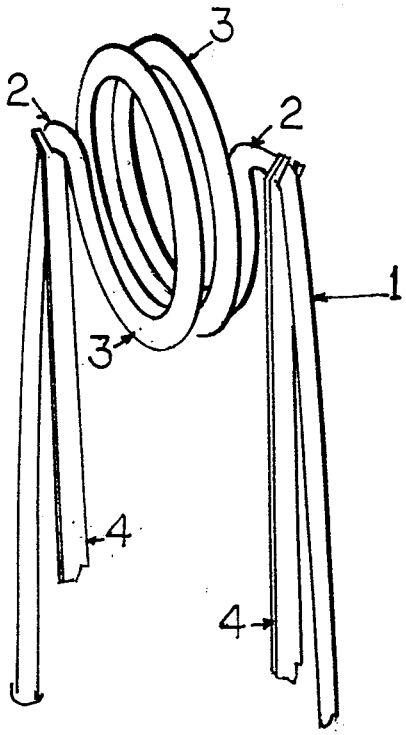
FIG. 4 is a perspective view showing the major coil, secondary coils and reinforcing members as they engage secondary coils, and connecting area for the unassembled rod ends.
Figure 3:
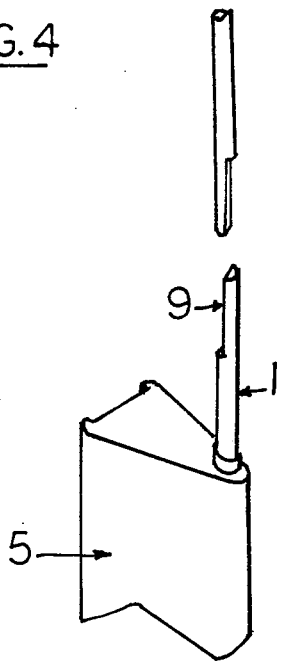
FIG. 3 shows a perspective view of a handgrip partially cross-sectioned to illustrate reinforcing member, elongated rod
Figure 3:
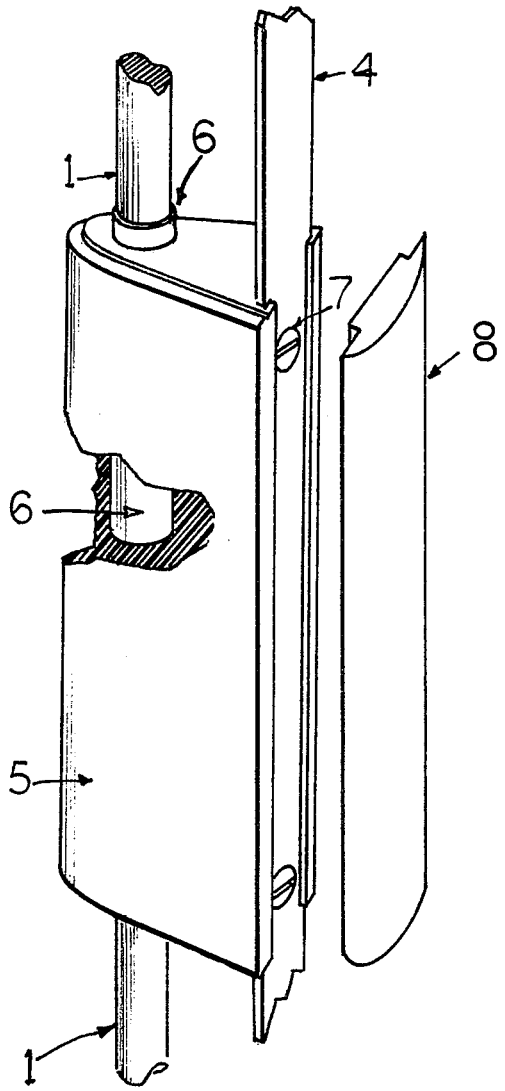

FIG. 1 is a front view of the exerciser which consists of one major coil (3) and two secondary coils (2) at each end of elongated members (1) which members are connected by two opposing handgrips (5) with reinforcing members (4) mounted to the handgrips and extending to each end of the device. The elongated members are metal rod available in various diameters and capacities of flexibility. It is first formed into the major coils then into secondary coiling; the remaining rod becomes the elongated member to either side of the coils and terminates at the handgrips (5) into which it is received and surrounded by sleeve like parts (6). Appreciably, the elongated rod members can be so varied in manufacture as to accommodate exercise from mild to strenuous.

It is the function of the sleeve parts to add stability to to the elongated members at the point where they are joined to the handgrips by making the elongated members immovable within the entire length of the handgrips. Flexing of the rod begins from the point of contact with the sleeve and proceeds throughout the device.

Each of the handgrips is molded from plastic material and forms a tight fit to the sleeve part (6). The handgrips (5) include an opening for receiving the elongated members (1) and the sleeve (6) as discribed above and having a channel formed thereinto for receiving the reinforcing member (4). The bracket (8) is friction fitted and adapted to be placed over the reinforcing member (4) to become an integral part of the handgrips (5).

The reinforcing members (4) of the exercise device pass through each respective handgrip (5) and are secured thereto by screws (7). The ends of the reinforcing members engage each of the secondary coils (2) through slotted and bent ends. This is a preferred method to immobilize the reinforcing members at a point midway between the coils to insure that the resistance generated in exercising will occur mainly at the slotted ends of the reinforcing members (4) as they abutt the secondary coils (2) thereby directing greater energy to the major coils (3). The tap which results from slotting the reinforcing member (4) can be bent in an outwardly direction toward the elongated member (1) so as to give additional seating or purchase between the reinforcing member (4) and the secondary coils (2).

The indented surface (9) on each of the elongaged members (1) endings are welded to one another to form the whole device form two halves. The handgrips, having been inserted upon one or the other elongated members (1) halves prior to the welding of the endings at the indented surface (9), can be pushed into their respective positions.

While there has been shown and described in this specification a preferred embodiment of the invention, it is to be understood that this embodiment is for the purpose of illustration and does not limit the invention in detail of construction or application within the spirit of the invention, such modification falling within the scope of the following claim:

What is claimed is:

1. A hand held grymnastic devices for pull and pull-relaxation exercise comprising:

two elongated members, a pair of handgrips and two reinforcing members;

each of said two elongated members forming major and secondary coils, said major coils being formed intermediate to the ends of each of said elongated members, said secondary coils formed adjacent to and on opposite sides of said major coils, said ends of said elongated members being joined to each other to form a continuous member, each of said reinforcing members having means at their ends to engage said secondary coils, said pair of handgrips adapted to receive the respective joined ends of said elongated members, means located on said handgrips for receiving and securing said reinforcing member thereto, means located on said handgrips for adding stability to the elongated members.

* * * * *